US009765481B2

(12) United States Patent
Malmquist et al.

(10) Patent No.: US 9,765,481 B2
(45) Date of Patent: Sep. 19, 2017

(54) FABRIC AND METHOD FOR PRODUCING SAME

(71) Applicant: VOITH PATENT GMBH, Heidenheim (DE)

(72) Inventors: Johan Malmquist, Katrineholm (SE); Kjell Karlsson, Örebro (SE); Conny Andersson, Högsjö (SE)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 14/913,517

(22) PCT Filed: Jul. 25, 2014

(86) PCT No.: PCT/EP2014/066016
§ 371 (c)(1),
(2) Date: Feb. 22, 2016

(87) PCT Pub. No.: WO2015/024733
PCT Pub. Date: Feb. 26, 2015

(65) Prior Publication Data

US 2016/0201264 A1 Jul. 14, 2016

(30) Foreign Application Priority Data

Aug. 23, 2013 (DE) ..... 10 2013 216 754

(51) Int. Cl.

| | |
|---|---|
| ***D21F 1/00*** | (2006.01) |
| ***D21F 7/08*** | (2006.01) |
| ***D04H 1/46*** | (2012.01) |
| ***D06H 5/00*** | (2006.01) |

(52) U.S. Cl.
CPC ..... *D21F 7/083* (2013.01); *D04H 1/46* (2013.01); *D06H 5/001* (2013.01); *D21F 1/0036* (2013.01); *D21F 7/086* (2013.01)

(58) Field of Classification Search
CPC .. D21F 1/00; D21F 7/083; D06H 5/00; D04H 1/46
USPC ..... 162/289
See application file for complete search history.

(56) References Cited

U.S. PATENT DOCUMENTS

| | | | |
|---|---|---|---|
| 4,842,905 | A | 6/1989 | Stech |
| 5,879,777 | A | 3/1999 | Shipley |
| 6,811,849 | B2 | 11/2004 | Best |
| 7,722,743 | B2 | 5/2010 | Best et al. |

(Continued)

FOREIGN PATENT DOCUMENTS

| | | | |
|---|---|---|---|
| DE | 102008000915 | A1 | 10/2009 |
| DE | 102011005673 | A1 | 9/2012 |

(Continued)

*Primary Examiner* — Mark Halpern
(74) *Attorney, Agent, or Firm* — Laurence A. Greenberg; Werner H. Stemer; Ralph E. Locher

(57) ABSTRACT

A fabric, in particular a press felt, is provided for use in a press section of a machine for producing a fiber web such as a paper, cardboard, or tissue web. The fabric is formed of multiple strips which are arranged adjacent one another and extend substantially parallel to one another in a machine direction. The strips together form a width of the fabric in the machine transverse direction. Each strip is designed as a double-layered sheet material. Strips arranged adjacently in respective pairs are connected by way of a connecting strip. A part of the width of each of the connecting strips extends in the machine transverse direction into the two adjacent strips. The strips are connected to the connecting strips.

21 Claims, 1 Drawing Sheet

(56) References Cited

U.S. PATENT DOCUMENTS

| | | | |
|---|---|---|---|
| 8,123,911 | B2 | 2/2012 | Koeckritz et al. |
| 2009/0293245 | A1 | 12/2009 | Kockritz |
| 2014/0014285 | A1 | 1/2014 | Straub et al. |

FOREIGN PATENT DOCUMENTS

| | | | |
|---|---|---|---|
| DE | 102011007291 | A1 | 10/2012 |
| EP | 1209283 | A1 | 5/2002 |
| EP | 1837440 | A1 | 9/2007 |
| EP | 2128335 | A1 | 12/2009 |

FABRIC AND METHOD FOR PRODUCING SAME

This application is a 371 of PCT/EP2014/066016 filed 25 Jul. 2014

BACKGROUND OF THE INVENTION

Field of the Invention

The invention pertains to a fabric for use in a machine for producing a fiber web such as a paper, board or tissue web, and also to a method for producing such a fabric.

Fabrics can be found in a large number of forms in a papermaking machine. Depending on the position, different tasks are assigned to the fabrics which, in addition to supporting and guiding the paper web, are used in particular for dewatering. The water present in the paper web in a decreasing amount as said web passes progressively through the machine must be carried away in a suitable form without the paper web being damaged in the process or suffering marking as a result of mechanical or hydraulic processes during the dewatering.

In particular in the press section, gentle dewatering is of central importance, since here the switches for the smoothing of the paper web are already set. After the initial dewatering in the forming section, the paper web is not yet dry enough to run through the machine in free draws, instead is usually guided and pressed on at least one felt or between two felts, depending on configuration.

Accordingly, the requirements on corresponding press felts in relation to the quality of the surface, the water absorption and re-discharge capacity, the tendency to re-wetting and the permeability to air and water are very high.

Press felts nowadays normally have a load-absorbing base structure, optionally one or more additional layers to reinforce or to improve the aforementioned properties and one or more layers of staple fibers. The latter constitute a bottleneck in the production, since the staple fiber layers can firstly be numerous and secondly pass through a multistage and partially operationally intensive production process before they are connected to the base structure. This connection is made via needling, in which a needle matrix acts on the staple fiber layer resting on the base structure and forces the individual fibers into the base structure and draws said fibers through the same and, as a result, permits a firm connection between base structure and staple fiber layers.

Current machines for producing paper or board often have a large working width, which can be up to 12 m. It is therefore obvious that the fabrics must have just such a width. The production of the fabrics in these dimensions becomes ever more complicated and expensive, however. In addition to the width of the weaving machines, the width of the needling machines and thus the high investment costs are a factor limiting the production.

It is thus in the interests of the paper machine operator and the fabric industry to look for solutions to producing fabrics in a simpler and more economical way and nevertheless in any desired dimension.

Various approaches thereto have already been developed a long time ago.

For example, from DE102011007291 A1 and DE 102008000915 A1 it is known to apply a reinforcing layer made of a knitted fabric or another nonwoven flat textile onto a base structure, transversely with respect to the machine direction, and to add the individual parts to one another until the full length of the base structure is covered.

However, the latter is formed in a familiar manner in the full length and width of the fabric.

The disadvantage here is in particular the fact that the reinforcing layer cannot be used on its own, since it does not offer sufficient stability, but only in conjunction with the base structure. In addition, the yarns are not crimped or curled, so that separation of the structure during the use of the fabric is to be feared.

EP 1209283 B1 discloses a fabric which, as seen in the transverse direction, has a plurality of partial webs extending parallel to one another in the longitudinal direction and arranged beside one another, the side edges of which are connected via connecting means. Adjacent side edges have a meandering course with alternating protrusions and recesses. The partial webs are meshed with one another via the protrusions and recesses.

The disadvantage with this prior art is to be seen in particular in the length of the connecting regions which, on account of the spiral winding of the partial webs, extend over a multiple of the length of the paper machine fabric. The production of such a felt is extremely complicated both in relation to the time factor and in relation to handling. In addition, when seam regions extend in the machine longitudinal direction, there is always the danger that these will lengthen to different extents when absorbing load and the felt will thus be damaged, which can result in an increased tendency to marking and in malfunctions as far as felt breakages with danger to the operating personnel and damage to following machine parts.

Furthermore, U.S. Pat. No. 4,842,905 discloses a paper machine fabric which is produced from individual panels, which have protrusions and recesses in the manner of a puzzle and can be connected together. Here, the panels can be extruded, punched out, laminated or produced in similar suitable methods.

The disadvantage with this prior art is the complex production, which requires many steps. Furthermore, the durability of the connections is questionable if only a small projection is available on a long edge. Multiple projections are once more associated with increased outlay on production of the individual panels. In general, it is difficult to produce a seam which is marking-free and operates with adequate stability. The structure of the aforementioned fabrics has seams or connections in multiple directions—machine direction and machine transverse direction—which increases the tendency to marking still further. The crossing points of the seams constitute particular weak points, both in relation to the stability and in relation to the tendency to marking.

U.S. Pat. No. 5,879,777 reveals a paper machine fabric which is produced from modular panels which are connected to one another by a touch and close strip or the like. Here, the individual panels are arranged to overlap in at least two layers and are connected both within the layer and also with the layer lying underneath by the aforementioned touch and close strips.

The stability of the paper machine fabrics thus produced, their suitability in particular in relation to the tendency to marking and the practicability in production may be doubted.

BRIEF SUMMARY OF THE INVENTION

It is thus an object of the invention to specify a fabric which avoids the aforementioned disadvantages of the prior art and which can be produced firstly in a simple and economical way and secondly with reliable high quality.

With regard to the fabric, the object is achieved by the characterizing features as claimed and, with regard to the method, by the characterizing features as claimed, in each case in combination with the generic features.

The fabric according to the invention, which in particular can be embodied as a press felt for use in a press section of a machine for producing a fiber web such as a paper, board or tissue web, has the following features: the fabric consists of multiple strips which are arranged beside one another and extend substantially parallel to one another in a machine direction; the strips together form a width of the fabric in the machine transverse direction; each strip is formed as a double-layer sheet material; strips each arranged beside one another in pairs are connected to one another by means of a connecting strip; a part of the width of each of the connecting strips extends in a machine transverse direction into the two adjacent strips; the strips are connected to the connecting strips.

The method according to the invention for producing the fabric has the following steps: i) producing a double-layer strip; ii) laying a single-layer or multilayer connecting strip in or on the double-layer strip over a sub region of the width of the connecting strip; iii) covering the strip with at least one staple fiber layer; and iv) needling the at least one staple fiber layer with the strip and the partial width of the connecting strip extending in the strip; v) repeating steps i) to iv) as far as the overall width of the fabric as seen in the machine transverse direction.

By means of the measures according to the invention, it is possible to ensure that the fabric can be produced stably and nevertheless particularly simply, since it is produced modularly, so that it is possible to dispense with equipment of full fabric width. This manifests itself primarily in the area of the needling machines which, with increasing fabric width, are both considerably more expensive to procure and also operate in a manner that requires intensive maintenance and is time-consuming.

Further advantageous aspects and developments of the invention emerge from the sub claims.

According to an advantageous aspect of the invention, provision can be made for the part of its width in the machine transverse direction by which each of the connecting strips extends into the two adjacent strips to be at least 5%, preferably at least 25%, particularly preferably 50%. As a result, a reliable connection can be achieved between the strips and the connecting strips.

The sheet material for strips and connecting strips can be chosen from: woven fabrics, laid fabrics, knitted fabrics, crocheted fabrics, spiral structure, tapes, films. By means of a suitable choice, the properties of the fabric can be modified and thus optimized to the respective running position and type of machine.

Advantageously, the sheet materials can have a width of 30 to 600 cm in a machine transverse direction. The maximum value results from about half of the width of modern fabrics, so that the needling sections accordingly have to have at most half the width of the fabric or less.

Advantageously, end edges of the double-layer sheet materials can be connected to one another to make the same endless, forming a tube-like material.

Preferably, the end edges can be connected by ultrasonic welding, laser welding, high-frequency welding, thermal welding, in particular by using a monofilament, adhesive bonding, in particular by using hot melt adhesives, filling with a resin or needling.

According to preferred design variants, the connecting strips can either be inserted between the layers of the double-layer strips or positioned on or under the layers of the double-layer strips.

According to one advantageous embodiment, the connecting strips can have the same width as the strips, as seen in the machine transverse direction. This results in a simple structure and the ability to position the connecting strips simply, which merely have to be laid so as to overlap the strips by approximately 50% and edge to edge with one another.

According to an advantageous embodiment that is an alternative hereto, the connecting strips can have a different width than the strips, as seen in the machine transverse direction. The connecting strips can be wider or narrower.

Auxiliary strips can preferably be provided if the extension of the connecting strips into the strips is less than 50%, said auxiliary strips being dimensioned such that a layer formed from the auxiliary strips and the connecting strips is formed without gaps in the machine transverse direction.

Advantageously, at least one layer of staple fibers can be arranged on one or both sides of the strips or between the layers of the strips.

Also preferably, it is possible to provide multiple staple fiber layers which have the same or different weights per unit area and/or the same or different fiber thicknesses.

According to one aspect of the invention, multiple strips can also be provided with at least one common staple fiber layer.

The at least one layer of staple fibers can usually be needled with the strips.

According to a further advantageous aspect of the invention, one or more functional layers can be arranged on the strips and/or on the connecting strips and/or between the layers of the strips and/or on the at least one staple fiber layer and/or between staple fiber layers and/or on the uppermost staple fiber layer as a covering layer.

The one or more functional layers can preferably be chosen from: films, foils, woven fabrics, laid fabrics, crocheted fabrics, knitted fabrics, nonwovens, impregnations.

The method according to the invention can advantageously provide for method step i) to have the following partial steps: i.i) providing a sheet material; i.ii) cutting a section of the sheet material to length to approximately four times the length of the fabric (1) to be produced; i.iii) connecting end edges of the section to produce an endless tube-like material; i.iv) laying the section on itself to produce a double-layer strip; i.v) positioning the connecting point of the end edges at a distance from the ends of the strip.

According to a further preferred aspect of the invention, method step ii) can have the following partial steps: ii.i) cutting a section of the sheet material to length to at least approximately twice the length of the fabric to be produced in order to produce a connecting strip; ii.ii) laying the total length of the connecting strip in or on the strip in a sub region of the width of the strip, the sub region being at least 5%, preferably at least 25%, particularly preferably 50%.

Particularly preferably, also provided as a further partial step of method step ii) can be laying auxiliary strips in or on if the extension of the connecting strips into the strips is less than 50%, which auxiliary strips are dimensioned such that a layer formed from the auxiliary strips and the connecting strips has no gaps in the machine transverse direction.

Preferably, step v) can be followed by a further step vi) for making the fabric endless, which step comprises the following partial steps: vi.i) forming terminal seam loops at both ends of the strips, which are formed in one piece with the strips or are connected detachably or non-detachably thereto; vi.ii) laying the seam loops of the ends in one another; vi.iii) connecting the seam loops by means of a push-in wire.

BRIEF DESCRIPTION OF THE SEVERAL VIEWS OF THE DRAWING

The invention will be described in more detail below with reference to the drawings, without restricting generality, by using preferred exemplary embodiments. In the figures.

DESCRIPTION OF THE INVENTION

It should be pointed out that the invention is not restricted to the embodiments of the examples described but is determined by the scope of the appended patent claims. In particular, the individual features in embodiments according to the invention can be implemented in a different number and combination than in the examples listed below. In the figures, the same or similar designations are used for functionally equivalent or similar characteristics, irrespective of specific embodiments.

Figure 1:
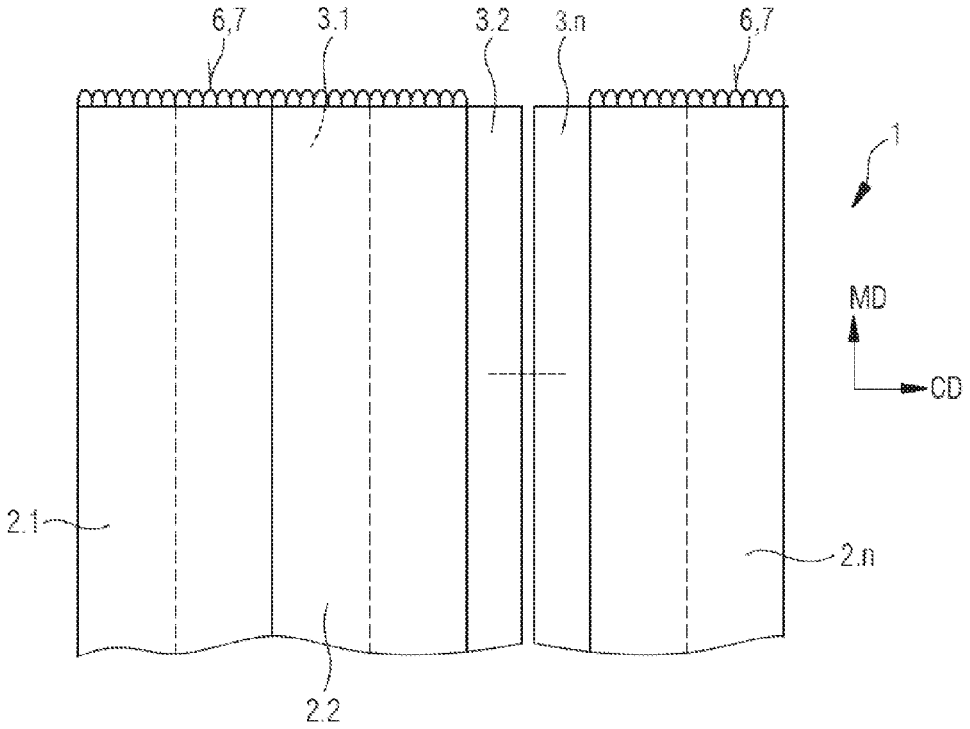
FIG. 1 shows a plan view of a fabric according to the invention.

FIG. 1 shows a fabric 1 in a schematic illustration. The fabric 1 can in particular be embodied as a press felt but also other fabric types such as forming and drying fabrics, and transport belts produced by means of the addition of polymer components can be imagined embodied in the manner of the invention.

Here, the fabric 1 comprises a plurality of substantially parallel strips 2.1, 2.2 . . . 2.*n*, which overall form the total width of the fabric 1. Here, the strips 2.1, 2.2 . . . 2.*n* are produced in the way described below. First of all, a sheet material is produced which, for example, can be produced in a known way as a flat fabric made of mutually crossing warp and weft threads in any desired weaving patterns. Alternatively, it is also possible to use spiral structures which have a number of plastic spirals which are laid down so as to interengage and are connected to one another by push-in wires. In addition, prefabricated tapes, laid fabrics, knitted fabrics, crocheted fabrics can be used, as can flat structures in the form of films. The sheet material can preferably have a width between 30 cm and 600 cm.

Following the production of the sheet material in any desired length, which is possible quickly and economically on familiar weaving machines, a piece is severed therefrom which corresponds approximately to four times the length of the subsequent fabric 1 as seen in a machine direction MD plus an addition for overlaps. The severed piece is folded and laid on itself, so that a material is produced which has double layers and is half the length of the severed piece. As a result, a first double-layer strip 2.1 has been produced. End edges are connected to form an endless tube-like material by fraying out some terminal yarns oriented in the machine transverse direction CD and subsequently interlacing and connecting the yarn ends oriented in the machine direction. Here, the connection can preferably be made by means of ultrasonic welding, laser welding, adhesive bonding, sewing or similar suitable methods. The connecting point between the end edges is not terminal, however, but is preferably arranged in approximately one third of the length of the strip 2.1.

The first of the double-layer strips 2.1 produced in this way is combined in a next step with a first connecting strip 3.1, having one layer in the exemplary embodiment, by the latter being laid between the layers of the double-layer strip 2.1. The first one-layer connecting strip 3.1 is likewise severed from the endless sheet material and has substantially the same length as the double-layer strip 2.1, that is to say twice the length of the fabric 1 to be produced. The positioning is carried out in such a way that the one-layer connecting strip 3.1, as seen in the machine transverse direction, is pushed in approximately as far as the center of the two-layer strip 2.1. The second half of the one-layer connecting strip 3.1 thus initially remains visible.

The thus combined semi-finished product comprising a double-layer strip 2.1 and a connecting strip 3.1 laid halfway in the latter is covered with at least one layer of staple fiber layers and, by using a needling machine, which advantageously has to have only the width of the double-layer strip 2.1, with which the at least one staple fiber layer is needled. In a known way, multiple staple fiber layers can be applied to one or both sides of the strip 2.1. The staple fiber layers can have different weights per unit area and fiber thicknesses. Furthermore, it is possible to introduce additional functional layers in the form of foils, membranes, films or else impregnations on the strip 2.1 or between the staple fiber layers. It is possible for further method steps of fusing the functional layers on, injecting and subsequently fusing particles on, etc, to be carried out. The number and type of these steps depends on the desired range of properties and on the position of use of the fabric 1. Since these steps are known per se, it is possible to dispense with an extensive description at this point.

Following the needling, a further double-layer strip 2.2, which has been produced in the above-described way, is positioned beside the first double-layer strip 2.1 and lying edge to edge with the latter, by the still visible part of the first connecting strip 3.1 being inserted into the newly arrived double-layer strip 2.2. From the other side, a second one-layer connecting strip 3.2 is added, being positioned between the layers of the second double-layer strip 2.2. After the material has been pushed into the needling machine in the machine transverse direction by the width of a strip 2.1, 2.2, . . . 2.*n*, the needling step is repeated following the addition of the desired number of staple fiber and/or functional layers.

The steps described above are then repeated until the complete width of the fabric 1, as seen in the machine transverse direction, is reached.

The strips 2.1, 2.2, . . . 2.*n* each lie beside one another edge to edge, the connecting strips 3.1, 3.2, . . . 3.*n* lie in the interior of the strips 2.1, 2.2, . . . 2.*n*, likewise edge to edge. The result is thus an overall three-layer structure formed without gaps. This is illustrated highly schematically in FIG. 2 in a section in the machine transverse direction.

Figure 2:
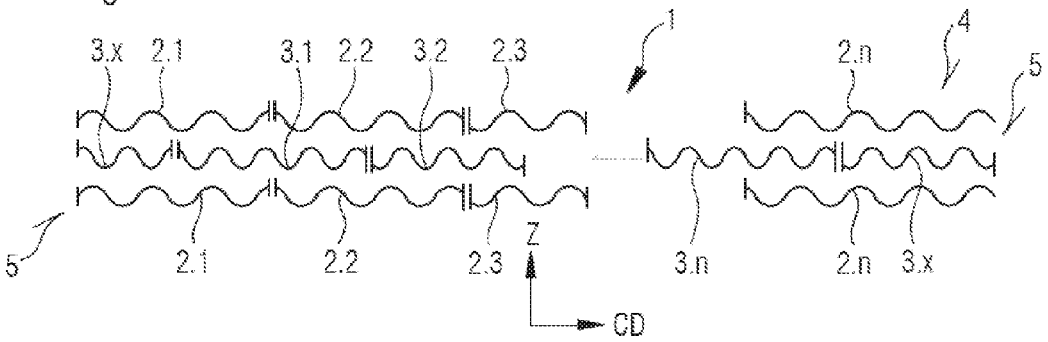
FIG. 2 shows a highly schematic lateral illustration of the fabric according to FIG. 1.

It is also possible to see in FIG. 2 how marginal regions 4 can be formed. Here, either half the width of the marginal strips 2.1 and 2.*n* can remain empty without the third layer made of the part of a connecting strip 3.*x* being added, which is generally not a problem, since the marginal regions 4 always have somewhat of a protrusion with respect to a fiber web resting on the fabric 1. Alternatively, as can be seen from FIG. 2, half a connecting strip 3.*x* can be inserted, then terminating flush with outer edges 5 of the first strip 2.1 and of the last strip 2.*n*.

Figure 3:
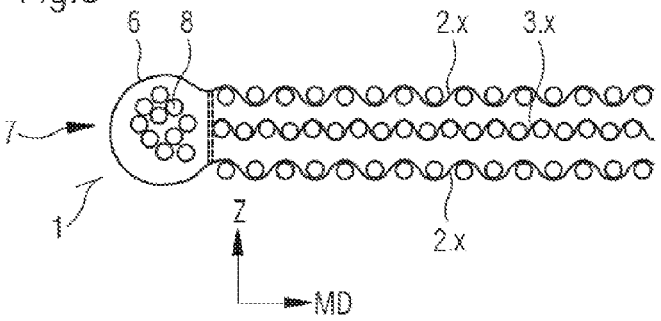
FIG. 3 shows a schematic lateral illustration of the fabric according to FIG. 2 with the viewing direction rotated through 90°.

In FIG. 3, the fabric 1 according to the invention is illustrated in the region of terminal seam loops 6, likewise in a side view but in a viewing direction rotated through 90° with respect to FIG. 2.

As already explained above, each of the strips 2.1, 2.2, . . . 2.*n* has a length which corresponds substantially to twice the length of the subsequent fabric 1. In order to make the fabric 1 endless, some of the yarns oriented in the machine transverse direction are removed at end edges 7 of the strips 2.1, 2.2, . . . 2.*n*. In the case of a spiral structure, a spiral additionally provided for this purpose or a seaming element can be attached. Films must likewise be equipped with a seaming element.

As a result of the removal of the yarns, seam loops 6 are formed which, with seam loops 6 which are formed in the same way at the other end of the strips 2.1, 2.2, . . . 2.*n*, can be connected to one another in the fiber web machine by the insertion of a push-in wire 8, forming an endless fabric 1.

In order to prevent a gap from occurring in the staple fiber layers in the region of the seam loops 6, here a slight excess length of the staple fiber layers needled onto the strips 2.1, 2.2, . . . 2.*n* can provide a remedy.

It should be noted that above, the exemplary embodiment illustrated in the figures was viewed in more detail at the point where the connecting strips 3.1, 3.2, . . . 3.*n* are formed in one layer, the connecting strips 3.1, 3.2, . . . 3.*n* are inserted between the layers of the strips 2.1, 2.2, . . . 2.*n*, the connecting strips 3.1, 3.2, . . . 3.*n* have the same width as the strips 2.1, 2.2, . . . 2.*n* and the connecting strips 3.1, 3.2, . . . 3.*n* are produced from the same type of sheet material as the strips 2.1, 2.2, . . . 2.*n*.

Alternatively, the further exemplary embodiments described below can be provided.

The connecting strips 3.1, 3.2, . . . 3.*n* can likewise be formed with multiple layers. If, for example, the connecting strips 3.1, 3.2, . . . 3.*n* are formed in an identical way to the strips 2.1, 2.2, . . . 2.*n*, as described above, the result that follows, after combination of the connecting strips 3.1, 3.2, . . . 3.*n* with the strips 2.1, 2.2, . . . 2.*n*, is an overall four-layer material.

It is likewise possible not to arrange the connecting strips 3.1, 3.2, . . . 3.*n* between the two layers of the strips 2.1, 2.2, . . . 2.*n* but on or under the strips 2.1, 2.2, . . . 2.*n*, and in each case such that a continuous surface is formed.

In a further conceivable embodiment, provision can be made for the connecting strips 3.1, 3.2, . . . 3.*n* to have a width which is lower than the width of the strips 2.1, 2.2, . . . 2.*n*. As a result, the overlap between the strips 2.1, 2.2, . . . 2.*n* and the connecting strips 3.1, 3.2, . . . 3.*n* is correspondingly lower than 50%. The gaps produced as a result could be closed by auxiliary strips, not illustrated further, the auxiliary strips being dimensioned such that a layer formed from the auxiliary strips and the connecting strips 3.1, 3.2, . . . 3.*n* is formed without gaps in the machine transverse direction CMD.

Alternatively, the width of the connecting strips 3.1, 3.2, . . . 3.*n* can also be greater than the width of the strips 2.1, 2.2, . . . 2.*n*. A preferred embodiment here would provide a width of the connecting strips 3.1, 3.2, . . . 3.*n* which is an integer multiple of the width of the strips 2.1, 2.2, . . . 2.*n*. As a result, it is possible to avoid butt joints without overlaps occurring.

Finally, it is further possible to make the connecting strips 3.1, 3.2, . . . 3.*n* from a different type of sheet material than the strips 2.1, 2.2, . . . 2.*n*. For example, the strips 2.1, 2.2, . . . 2.*n* can comprise a flat woven textile with longitudinal and transverse threads, as described above, and the connecting strips 3.1, 3.2, . . . 3.*n* of a film or a crocheted fabric, for example.

The invention claimed is:

1. A fabric, comprising:

a plurality of strips disposed beside one another and extending substantially parallel to one another in a machine direction;

said strips together forming a width of the fabric in a machine transverse direction;

each said strip being formed as a double-layer sheet material;

connecting strips connecting mutually adjacent strips that are arranged beside one another in pairs to one another;

a part of a width of each of said connecting strips extending in the machine transverse direction into the two adjacent said strips;

wherein said strips are connected to said connecting strips, and said connecting strips are inserted between layers of said double-layer strips.

2. The fabric according to claim 1, wherein the part of the width of each connecting strip in the machine transverse direction by which each of said connecting strips extends into the two adjacent strips is at least 5% of the width thereof.

3. The fabric according to claim 1, wherein said sheet material is selected from the group consisting of woven fabrics, laid fabrics, knitted fabrics, crocheted fabrics, spiral structure, tapes, and films.

4. The fabric according to claim 1, wherein said sheet material has a width of 30 to 600 cm in the machine transverse direction.

5. The fabric according to claim 1, wherein end edges of said double-layer sheet materials are connected to one another, rendering the double-layer sheet materials endless, forming a tube-like material.

6. The fabric according to claim 5, wherein the end edges are connected by a process selected from the group consisting of ultrasonic welding, laser welding, high-frequency welding, thermal welding, thermal welding with a monofilament, adhesive bonding, gluing with hot melt adhesives, filling with a resin and needling.

7. The fabric according to claim 1, wherein said connecting strips have the same width as said strips in the machine transverse direction.

8. The fabric according to claim 1, wherein a width of said connecting strips is different than a width of said strips in the machine transverse direction.

9. The fabric according to claim 1, which comprises auxiliary strips provided if an extension of said connecting strips into said strips is less than 50% of a width of said connecting strips, said auxiliary strips being dimensioned such that a layer formed from said auxiliary strips and said connecting strips is formed without gaps in the machine transverse direction.

10. The fabric according to claim 1, which comprises at least one layer of staple fibers arranged on one or both sides of said strips or between layers of said strips.

11. The fabric according to claim 10, wherein said at least one layer of staple fibers are multiple staple fiber layers which have the same or different weights per unit area and/or the same or different fiber thicknesses.

12. The fabric according to claim 10, wherein multiple strips are provided with at least one common staple fiber layer.

13. The fabric according to claim 10, wherein said at least one layer of staple fibers is needled with said strips.

14. The fabric according to claim 10, which further comprises one or more functional layers arranged as a covering layer in one or more or all of the following positions:

on said strips;

on said connecting strips;

between the layers of said strips;

on said at least one staple fiber layer;

between staple fiber layers; and/or on an uppermost said staple fiber layer.

15. The fabric according to claim 14, wherein said one or more functional layers are selected from the group consisting of films, foils, woven fabrics, laid fabrics, crocheted fabrics, knitted fabrics, nonwovens, and impregnations.

16. A fabric, comprising:

a plurality of strips disposed beside one another and extending substantially parallel to one another in a machine direction;

said strips together forming a width of the fabric in a machine transverse direction;

each said strip being formed as a double-layer sheet material;

connecting strips connecting mutually adjacent strips that are arranged beside one another in pairs to one another;

a part of a width of each of said connecting strips extending in the machine transverse direction into the two adjacent said strips; and wherein said strips are connected to said connecting strips; and at least one layer of staple fibers arranged on one or both sides of said strips or between layers of said strips and needled with said strips.

17. A method of producing the fabric according to claim 1, the method comprising:

i) producing a double-layer strip;

ii) laying a single-layer or multilayer connecting strip in or on the double-layer strip over a sub region of a width of the connecting strip;

iii) covering the strip with at least one staple fiber layer;

iv) needling the at least one staple fiber layer with the strip and the partial width of the connecting strip extending in the strip; and v) repeating steps i) to iv) as far as the overall width of the fabric as seen in the machine transverse direction.

18. The method according to claim 17, wherein method step i) comprises the following partial steps:

i.i) providing a sheet material;

i.ii) cutting a section of the sheet material to length to approximately four times a length of the fabric to be produced;

i.iii) connecting end edges of the section to produce an endless tube-like material;

i.iv) laying the section on itself to produce a double-layer strip; i.v) positioning a connecting point of the end edges at a distance from the ends of the strip.

19. The method according to claim 17, wherein method step ii) comprises the following partial steps:

ii.i) cutting a section of the sheet material to length to at least approximately twice a length of the fabric to be produced in order to produce a connecting strip;

ii.ii) laying a total length of the connecting strip in or on the strip in a sub region of the width of the strip, the sub region being at least 5% thereof.

20. The method according to claim 19, wherein method step ii) further comprises, as a further partial step, laying auxiliary strips in or on if the extension of the connecting strips into the strips is less than 50%, wherein the auxiliary strips are dimensioned such that a layer formed from the auxiliary strips and the connecting strips has no gaps in the machine transverse direction.

21. The method according to claim 17, which comprises, following step v), making the fabric endless in a step vi), which comprises:

vi.i) forming terminal seam loops at both ends of the strips, which are formed in one piece with the strips or are connected detachably or non-detachably thereto;

vi.ii) laying the seam loops of the ends in one another; and vi.iii) connecting the seam loops by way of a push-in wire.

* * * * *